US011096435B2

(12) United States Patent
Kamphuis et al.

(10) Patent No.: US 11,096,435 B2
(45) Date of Patent: Aug. 24, 2021

(54) PROTECTIVE GLOVE

(71) Applicant: CrossGuard IP B.V., Delft (NL)

(72) Inventors: Maarten Alexander Kamphuis, Weerselo (NL); Youval You-wei Kuipers, Delft (NL)

(73) Assignee: CROSSGUARD IP B.V., Delft (NL)

( * ) Notice: Subject to any disclaimer, the term of this patent is extended or adjusted under 35 U.S.C. 154(b) by 11 days.

(21) Appl. No.: 16/083,995

(22) PCT Filed: Mar. 10, 2017

(86) PCT No.: PCT/NL2017/050155
§ 371 (c)(1),
(2) Date: Sep. 11, 2018

(87) PCT Pub. No.: WO2017/160143
PCT Pub. Date: Sep. 21, 2017

(65) Prior Publication Data

US 2019/0328062 A1 Oct. 31, 2019

(30) Foreign Application Priority Data

Mar. 12, 2016 (NL) ..... 2016426
Aug. 26, 2016 (NL) ..... 2017378

(51) Int. Cl.
*A41D 19/015* (2006.01)

(52) U.S. Cl.
CPC . *A41D 19/01505* (2013.01); *A41D 19/01588* (2013.01)

(58) Field of Classification Search
CPC ..... A41D 19/01505; A41D 19/01588; A41D 19/015; A41D 19/0089; A41D 19/00
(Continued)

(56) References Cited

U.S. PATENT DOCUMENTS 381,687 A * 4/1888 Fischer ..... A63B 71/143 2/19
1,174,887 A * 3/1916 Meriwether ..... A61F 13/105 294/25

(Continued)

FOREIGN PATENT DOCUMENTS

DE 10329796 B3 * 12/2004 ..... A63B 71/148
DE 102006057245 A1 * 6/2008 ..... A63B 71/141

(Continued)

OTHER PUBLICATIONS

PCT International Search Report and Written Opinion from PCT/NL2017/050155 dated May 2, 2017, 12 pages.

(Continued)

*Primary Examiner* — Alissa J Tompkins
*Assistant Examiner* — Brieanna Szafran
(74) *Attorney, Agent, or Firm* — Kacvisnky Daisak Bluni PLLC

(57) ABSTRACT

A protective glove includes at least a first finger section and a second finger section, each finger section comprising a protective layer configured to be at least partially arranged over a finger part of a user; and a pivot connecting said first finger section and said second finger section. The pivot has a pivot axis that substantially coincides with a finger joint of a user's hand. One of the first and second finger section comprises a rounded protrusion and wherein the other of the first and second finger section comprises a corresponding rounded recess configured to receive said rounded protrusion, said protrusion and recess together forming said pivot connecting said first finger section and said second finger section. The first and second finger section and said pivot define a substantially continuous and flush wall.

14 Claims, 11 Drawing Sheets

(58) Field of Classification Search
USPC ..... 2/21
See application file for complete search history.

(56) References Cited

U.S. PATENT DOCUMENTS 1,268,103 A * 6/1918 Fleming ..... A41D 13/087 2/21
1,388,618 A * 8/1921 Stein ..... A41D 19/01517 2/21
1,509,801 A * 9/1924 Walters ..... A41D 19/01588 2/19
1,951,190 A * 3/1934 Gambee ..... D05B 91/04 2/21
4,272,849 A * 6/1981 Thurston ..... A41D 19/01517 2/16
5,147,285 A * 9/1992 Buxton ..... A61F 5/013 602/16
5,232,436 A * 8/1993 Janevski ..... A61F 5/013 602/22
6,557,177 B2 * 5/2003 Hochmuth ..... A41D 19/015 2/159
6,684,406 B2 * 2/2004 Fowler ..... A41D 13/084 2/16
7,574,748 B2 * 8/2009 Fisher ..... A41D 19/01588 2/16
7,802,315 B2 * 9/2010 Contant ..... A63B 71/143 2/161.1
8,181,275 B2 * 5/2012 Saturnio ..... A41D 19/01588 2/161.1
8,955,163 B2 * 2/2015 Mazzarolo ..... A41D 19/01505 2/16
2002/0184695 A1 12/2002 Flowler
2005/0114982 A1 6/2005 Gremmert
2008/0086789 A1 4/2008 Dick
2009/0172864 A1 * 7/2009 Fisher ..... A41D 19/01588 2/161.1
2009/0307821 A1 * 12/2009 Chang ..... A63B 71/148 2/21
2011/0107498 A1 * 5/2011 Chang ..... A41D 19/01588 2/163
2012/0266357 A1 * 10/2012 Nix ..... A63B 71/148 2/161.1
2018/0317578 A1 * 11/2018 Furukawa ..... A41D 19/0089

FOREIGN PATENT DOCUMENTS

DE 102007043823 A1 * 12/2008 ..... A63B 71/148
JP 2001279503 A * 10/2001 ..... A41D 19/01588
WO 2014041320 A1 3/2014

OTHER PUBLICATIONS

PCT International Preliminary Report on Patentability from PCT/NL2017/050155 dated Apr. 23, 2017, 6 pages.
Bridget Butler Millsaps: "Glove One: the 3D Printed Smartphone Glove I 3DPrint.com", Jan. 26, 2015 (Jan. 26, 2015), XP055329911, Retrieved from the Internet: URL:https://3dprint.com/39192/glove-onesmartphone on Sep. 11, 2018, 6 pages.

* cited by examiner

PROTECTIVE GLOVE

This is a national stage application filed under 35 U.S.C. § 371 of pending international application PCT/NL2017/050155, filed Mar. 10, 2017, which claims priority to Netherlands Patent application NL2016426, filed Mar. 12, 2016 and also claims priority to Netherlands Patent application NL2017378, filed Aug. 26, 2016, the entirety of which applications are hereby incorporated by reference herein.

The present invention relates to a protective glove.

Gloves are commonly used for protecting a hand against adverse conditions, such as thermal conditions (cold or heat), chemical conditions (acids, etc.), or mechanical conditions (abrasion or impact). Different protective conditions often have conflicting demands. For example, a comfortable glove providing sensitive control and impact resistance at the same time has contradictory demands.

Motorcycle gloves designed for motorsports comprise a soft inner layer, providing a good feeling on the steer of the motorbike. The outer parts of the glove are normally provided with hard shell elements, aimed at protecting the hand against abrasion during sliding, e.g. resulting from a skidding. While motorcycle gloves offer valuable protection against abrasion, they are not designed for high impact situations.

In industry and some sports, such as Historical European Martial Arts (HEMA), demands are so high that current protective gloves are not good enough. For example, in HEMA, fighters are exposed to real impacts of a blunted steel sword. In industry, sensitive touch is often required for controlling machinery.

The article "Glove One: The 3D Printed Smartphone Glove" discloses a 3D printed smartphone that is integrated in a glove. The glove has an integrated electronic circuits and components. This glove, which forms the closest prior art, comprises pivot joints. The finger sections are shaped in such a way that a user may close his/her hand. However, when the user extends his/her fingers, the shape of the finger sections form spaces where the sides of the fingers of the user are exposed, e.g. to puncture by sharp objects. Due to the integrated electronics, the smartphone glove is vulnerable to impact, and it is therefore clearly not intended to protect against impact situations.

U.S. Pat. No. 4,272,849 discloses a protective glove for being worn by a workman, the glove including stainless steel plates positioned against the backhand side so to protect the hand against being crushed. This glove is designed to protect against pressure, not against impact.

US-A1-2008/086789 also discloses a protective glove against puncture, and is designed to be worn by a user of pneumatic devices, such as nailers, for protection against nail misfiring. Only the exposed area of the hand, in a specific orientation of said hand, is covered to stop or impede e.g. a nails's momentum. The cover parts may be integrated in a glove, or held in place on the hand by other means such as an elastic strap.

US-A1-2005/114982 discloses a protective glove having a flexible liner conforming to the shape of a hand and wrist and having a plurality of rigid guards secured thereto over the distal, middle, and proximal phalanx bones, the metacarpals, and wrist bones of the wearer. The glove may protect a user against blunt force injury. The distal, middle, and proximal guards secure to the liner spaced apart from one another, leaving the anterior side of the liner over the phalangeal joints exposed to facilitate articulation thereof.

WO-A1-2014/041320 and US-A1-2002/184695 are acknowledged as further prior art.

An object of the present invention is to provide a protective glove, that is improved relative to the prior art and wherein at least one of the above stated problems is obviated.

Said object is achieved with the protective glove according to the present invention, said protective glove comprising:

- at least a first finger section and a second finger section, each finger section comprising a protective layer configured to be at least partially arranged over a finger part of a user;
- a pivot connecting said first finger section and said second finger section;
- wherein said pivot has a pivot axis that substantially coincides with a finger joint of a user's hand;
- wherein one of the first and second finger section comprises a rounded protrusion and wherein the other of the first and second finger section comprises a corresponding rounded recess configured to receive said rounded protrusion, said protrusion and recess together forming said pivot connecting said first finger section and said second finger section; and
- wherein the first and second finger section and said pivot define a substantially continuous and flush wall.

The pivot axis substantially coincides with a finger joint of a user's hand, and therefore the pivot is arranged at a lateral side of the finger joint, i.e. not at a dorsal or palm side. If the pivot is arranged between adjacent fingers, the space is limited if a forced spreading of the fingers due to bulky pivots is to be prevented. However, by the feature of the first and second finger section and said pivot defining a substantially continuous and flush wall, the amount of material between adjacent fingers is minimized. The rounded protrusion and corresponding rounded recess allow the pivot having non-overlapping relationship between the first and second finger section.

The pivot defined by the mating rounded protrusion and the corresponding rounded recess on the one hand allows for a flush outer surface that only requires a limited wall thickness.

On the other hand, it also allows for a substantially continuous and flush wall being defined by the first and second finger section and said pivot. The fingers will be protected by said wall in both an extended and a bend state of the finger.

It is to be understood that continuous should be interpreted in a protective meaning, i.e. the wall provides a substantially continuous protection along its length. The skilled person will understand that small openings, such as ventilation holes, will not negatively influence the protection characteristics of said wall.

Because the first and second finger section and said pivot define a substantially continuous and flush wall, they require a limited space around a protected finger. Especially if two adjacent fingers of a user's hand are protected by finger sections according to the invention, this limited space allows the user to maintain a normal and comfortable posture of his or her hand. Especially a necessary spreading of the fingers is prevented.

Further objectives, benefits or inventive effects, are attained according to the present disclosure by the assembly of features in the appended claims.

The invention also encompasses a computer-readable medium having computer-executable instructions adapted to cause a 3D printer to print a finger section and/or other parts of a protective glove according to the invention and/or to print a mould for such a finger section and/or for such other parts of a protective glove according to the invention.

In the following description preferred embodiments of the present invention are further elucidated with reference to the drawing, in which.

Figure 1:
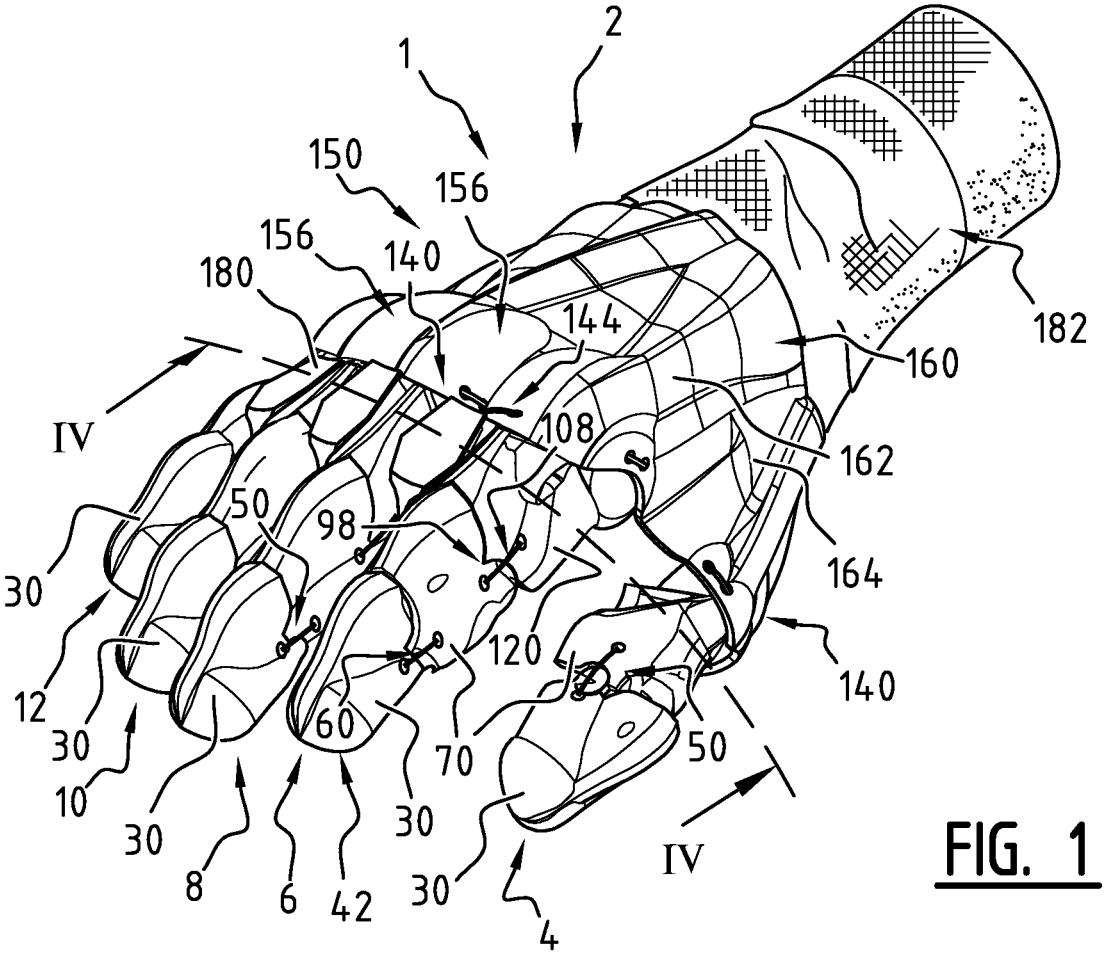
FIGS. 1 and 2 are perspective view of a protective glove according to a first embodiment of the invention.
Figure 2:
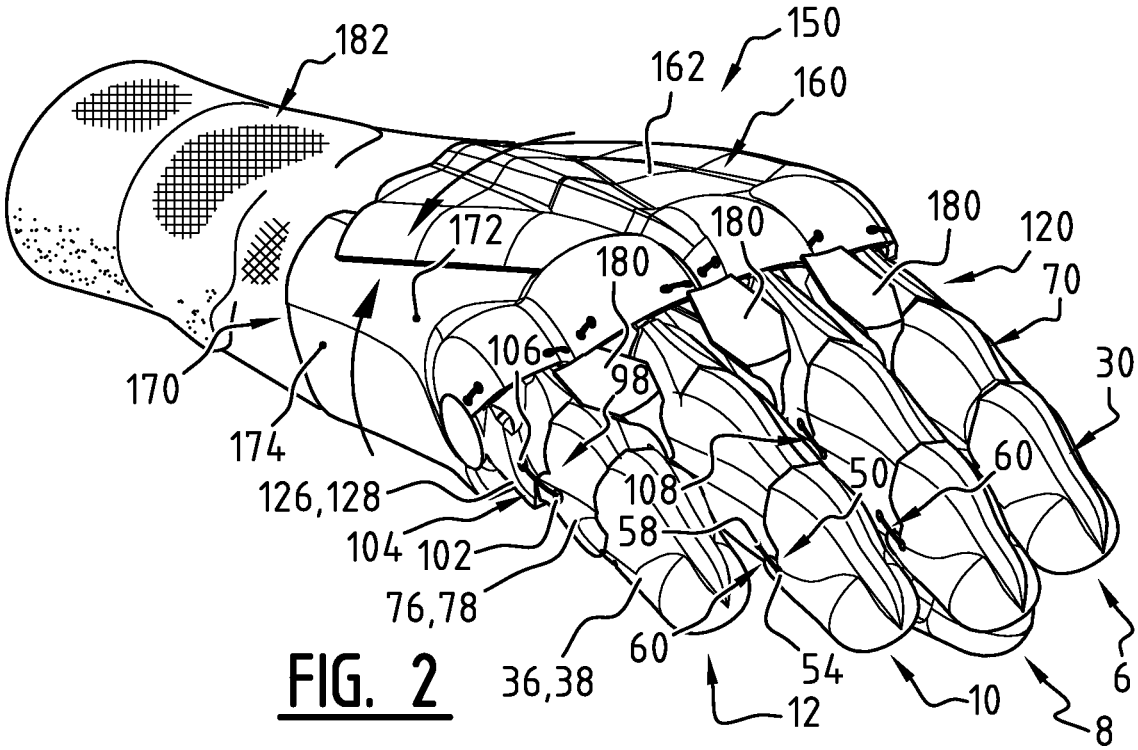
Figure 16:
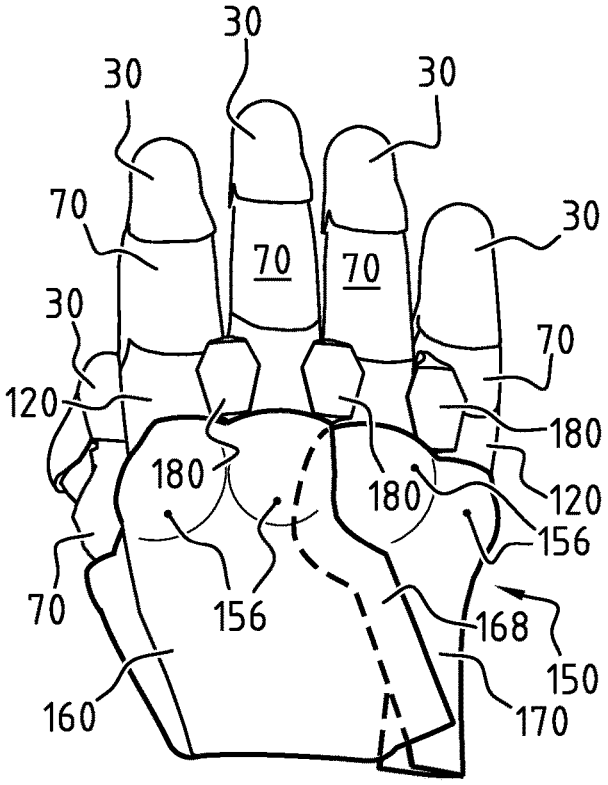
FIG. 16 is a top view of a protective glove in the hand position of FIG. 15.

A protective glove 1 for a hand 2 is shown in FIGS. 1, 2 and 16. This protective glove 1 comprises at least a first finger section 30 and a second finger section 70.

Figure 15:
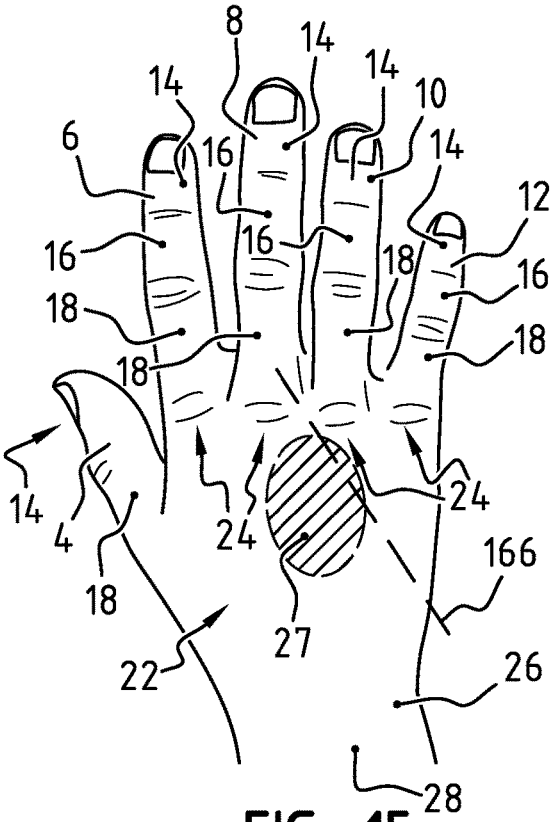
FIG. 15 is a top view of a hand indicating different hand and finger parts.

A thumb 4 only comprises a distal phalanx 14 and a proximal phalanx 18. Other fingers, such as index finger 6, middle finger 8, ring finger 10 and little finger 12, also comprise a middle phalanx 16 (FIG. 15). In view of the present invention, a first finger section 30 is associated with the distal phalanx 14 of all fingers 6, 8, 10, 12, including the thumb 4. For this invention, the thumb 4 is interpreted as a finger. A second finger section 70 is associated with the middle phalanx 16 of the index finger 6, the middle phalanx 16 of the middle finger 8, the middle phalanx 16 of the ring finger 10 and the middle phalanx 16 of the little finger 12. Furthermore, for the thumb 4, the second finger section 70 is associated with the proximal phalanx 18. The index finger 6, middle finger 8, ring finger 10 and little finger 12, further also comprise a third finger section 120, that is associated with the proximal phalanges 18 of these fingers (FIG. 16).

Each finger section 30, 70, 120 comprises a protective layer 32, 72, 122 configured to be at least partially arranged over a finger part of a user. The finger sections 30, 70, 120 are shown in detail in FIGS. 5-8. The protective layers 32, 72, 122 of the finger sections 30, 70, 120, as well as protective layers 152 of a dorsal hand section 150 distribute an impact over a larger surface, thereby deforming a larger area of a damping layer 40, 80, 130, 154. Due to the larger loaded area, the pressure is reduced and an increased area of the damping layer 40, 80, 130, 154 is activated for absorbing impact energy.

Figure 5:
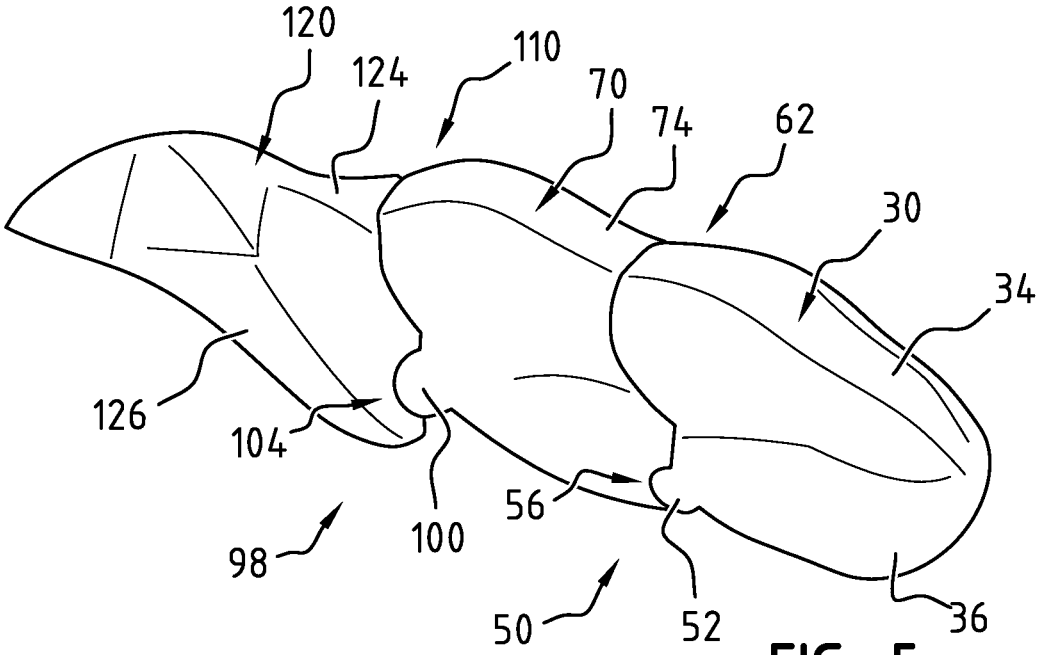
FIG. 5 is a perspective view of a finger of the protective glove in a first state.
Figure 6:
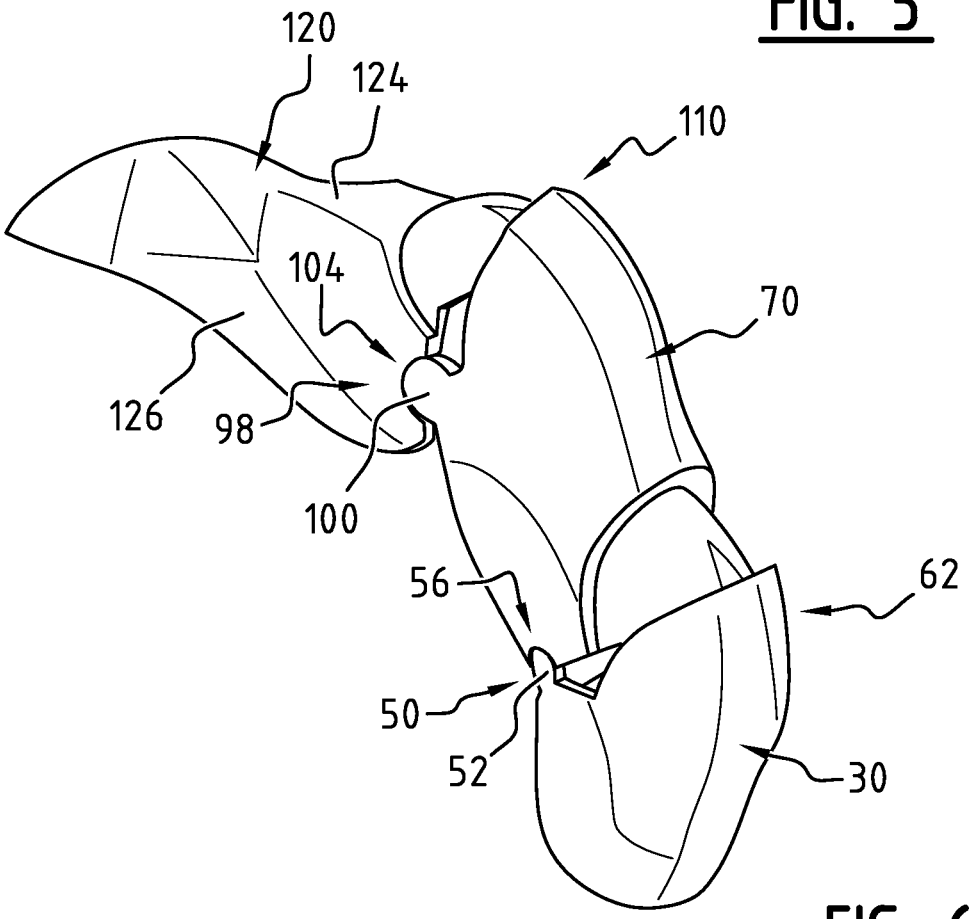
FIG. 6 is a perspective view of a finger of the protective glove in a second state.

A pivot 50 connects said first finger section 30 and said second finger section 70, wherein the first finger section 30 and the second finger section 70 and said pivot 50 define a substantially continuous and flush wall, as shown in FIGS. 5 and 6. The third finger section 120 is in a similar manner pivotally connected with a second pivot 98 to said second finger section 70.

One of the first 30 and second finger section 70 comprises a rounded protrusion 52 and the other of the first 30 and second finger section 70 comprises a corresponding rounded recess 56 configured for receiving said rounded protrusion 52. The protrusion 52 and recess 56 together form the first pivot 50 connecting the first finger section 30 and the second finger section 70. The protrusion 52 and recess 56 provide a first pivot 50 having a non-overlapping relationship between the first 30 and the second finger section 70 at the pivot. The arrangement of the protrusion 52 and the recess 56 provide the non-overlapping relationship such that there is no lateral overlap, defined in a direction along the pivot axis, between the first and the second finger sections at the pivot. In this way, the first 30 and second finger section 70 and said first pivot 50 define a substantially continuous and flush wall, and the amount of material between adjacent fingers is minimized.

Likewise, preferably also one of second finger section 70 and third finger section 120 comprises a rounded protrusion 100 and the other of the second 70 and third finger section 120 comprises a corresponding rounded recess 104 configured for receiving said rounded protrusion 100. The protrusion 100 and recess 104 together form the second pivot 98 connecting the second finger section 70 and the third finger section 120.

In the shown embodiment, both the first pivot 50 and the second pivot 98 are arranged on a neutral line of said finger. The neutral line is a line defining the same length between a knuckle and the tip of a respective finger in the extended and bend state of said finger. If the pivot is arranged on said neutral line, the pivot axis thereof passes through said neutral line. Consequently, relative movement of the first 30 and second finger section 70, and relative movement of the second 70 and third finger section 120 with respect to each other is substantially free of stretch and compression. The result is a comfortable glove that can be moved through its range of motion with minimal muscular effort. Of course, such an arrangement may also be applied for only one of the first 50 and second pivot 98. Conventional gloves have the disadvantage that the outer layer is stretched when the hands are closed, i.e. when a first is made or something is gripped. This stretching may cause fatigue when a user repeatedly has to stretch his/her hands and grip objects. For this reason, gloves are often designed for optimal comfort during one specific use: a motorcycle glove is generally designed to provide a comfortable fit when the user holds the grip of the steer. Such motorcycle gloves are less comfortable with stretched hands.

As shown in FIGS. 1 and 2, the first 30 and second finger sections 70, and the second 70 and third finger sections 120 are connected via a cable 60, 108 passing through the first pivot 50 and second pivot 98 respectively. The cable passes through associated holes 54, 58 and 102, 106. Of course, such an arrangement may also be applied for only one of the first 50 and second pivot 98. The cable 60, 108 may be pre-tensioned using a (not shown) elastic member in order to prevent elongation of said cable during use. Alternatively, a substantially stretch-free cable, e.g. made out of Dyneema® or another suitable material, may be used.

The protective layer 32, 72, 122 has a U-shape having a base 34, 74, 124 and two legs 36, 76, 126, wherein the wall thickness of the base 34, 74, 124 is at least two times larger, preferably at least three times larger, and more preferably at least four times larger than the wall thickness of at least one of the legs 36, 76, 126 of said U-shaped protective layer 32, 72, 122. The legs follow the shape of the sides of the fingers, and due to the combination of small thickness and material properties can gently clamp the finger without causing the sensation of pressure, even while moving from the first to the second state and thus increasing the width of the finger.

The legs 36, 76, 126 of the finger sections 30, 70, 120 and legs 164, 174 of a first dorsal hand part 160 and a second dorsal hand part 170, significantly increase the moment of inertia of the profile of the finger sections 30, 70, 120 and dorsal hand parts 160, 170, and thus the stiffness thereof. The legs 36, 76, 126 also prevent the protective layer 32, 72, 122 to be pressed aside as a result of impact, which would leave the finger 4, 6, 8, 10, 12 exposed.

The legs 36, 76, 126 preferably extend a distance from the base 34, 74, 124 that is large enough to prevent a finger 4, 6, 8, 10, 12 from being crushed by a heavy load, i.e. the space enclosed by the legs 36, 76, 126, the base 34, 74, 124 and the damping layer 40, 80, 130 preferably enough to allow circulation of blood even when the hand 2 is stuck between two objects.

A damping layer 40, 80, 130 is arranged against said base 34, 74, 124 of said U-shaped protective layer 32, 72, 122 and configured to be arranged against a finger part of said user.

A finger section 30, 70, 120 of an outer finger, such as a little finger 12 and/or an index finger 6 and/or a thumb 4, comprises an outer leg 38, 78, 128 of the U-shaped protective layer 32, 72, 122 on an outer side facing away from said protective glove 1, wherein this outer leg 38, 78, 128 preferably has a larger wall thickness than an inner leg 36, 76, 126 of said U-shaped protective layer 32, 72, 122 of said outer finger 4, 6, 12. The outer legs 38, 78, 128 protect the most exposed finger parts against impact and abrasion.

Figure 4:
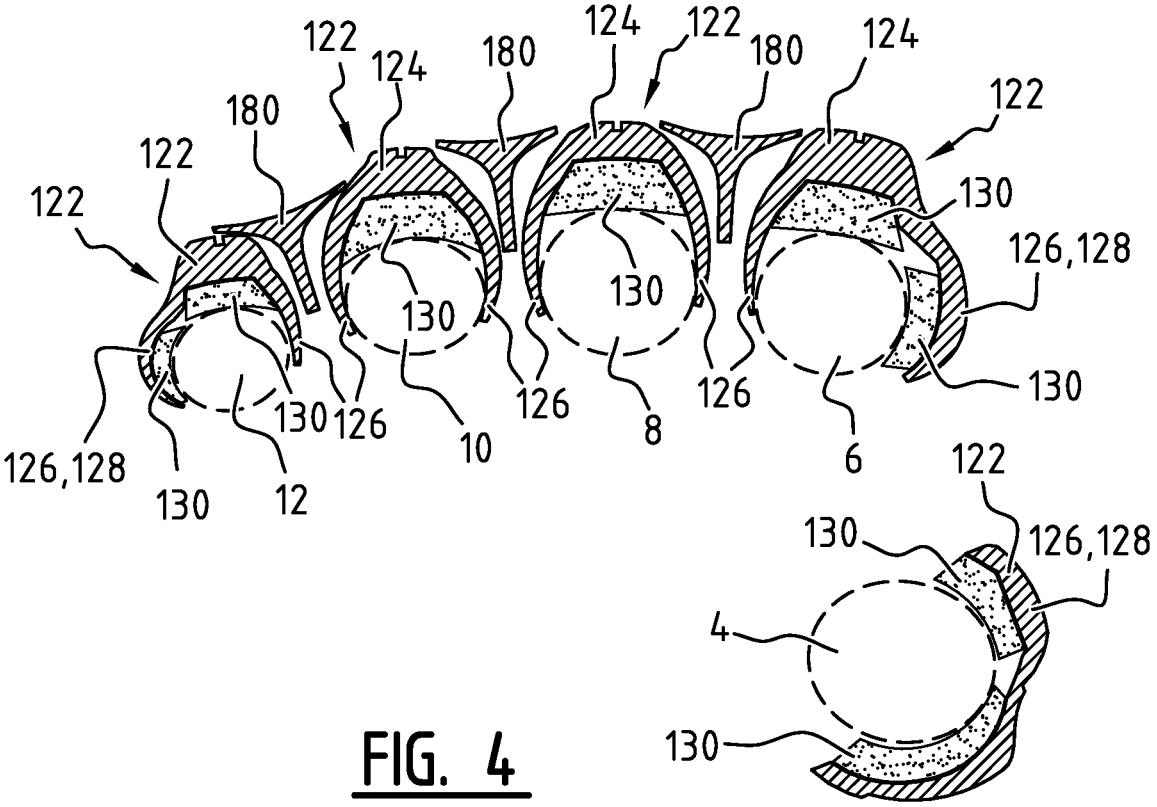
FIG. 4 is a cross sectional view from the protective glove according tot FIGS. 1-3.

Preferably, a further damping layer 130 is arranged against the outer leg 38, 78, 128 of the U-shaped protective layer 32, 72, 122 and configured to be arranged against a finger part of said user (FIG. 4). Due to this further damping layer 130 that is arranged on the most exposed finger parts of the little finger 12, index finger 6 and thumb 4, they are better protected against impact.

Although the thumb as shown in FIG. 4 only comprises one outer leg 128 with a larger wall thickness, it is remarked that the relatively large range of motion of a thumb provides sufficient space for the U-shaped protective layer 122 arranged around said thumb to be provided with a large wall thickness also on the side of the thumb facing the hand, i.e. being directed towards the index finger.

Figure 7:
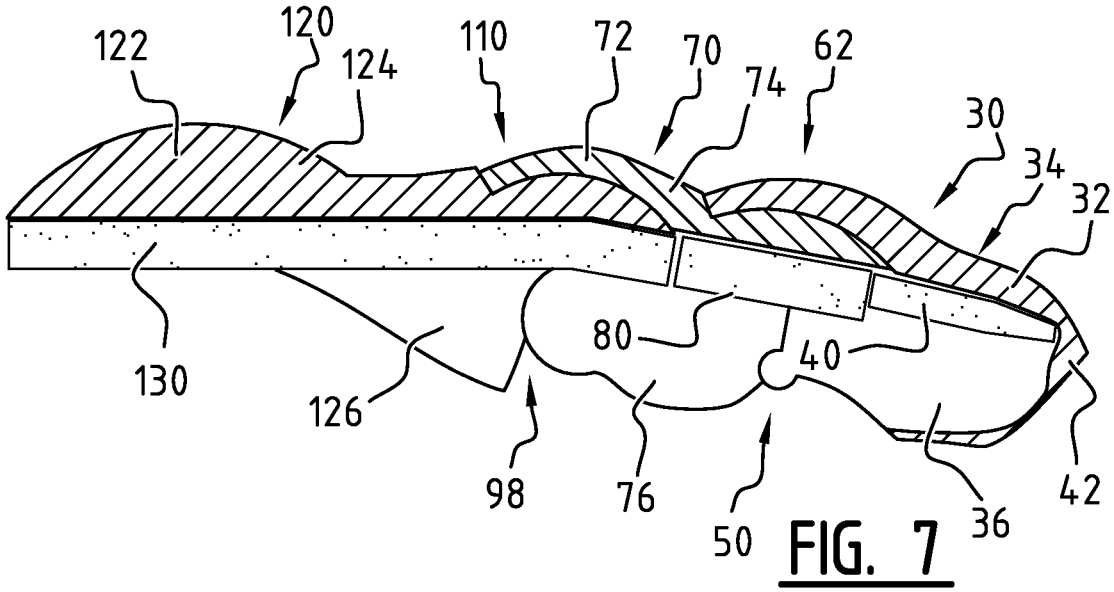
FIG. 7 is a cross sectional view of a finger in the first state of FIG. 5.
Figure 8:
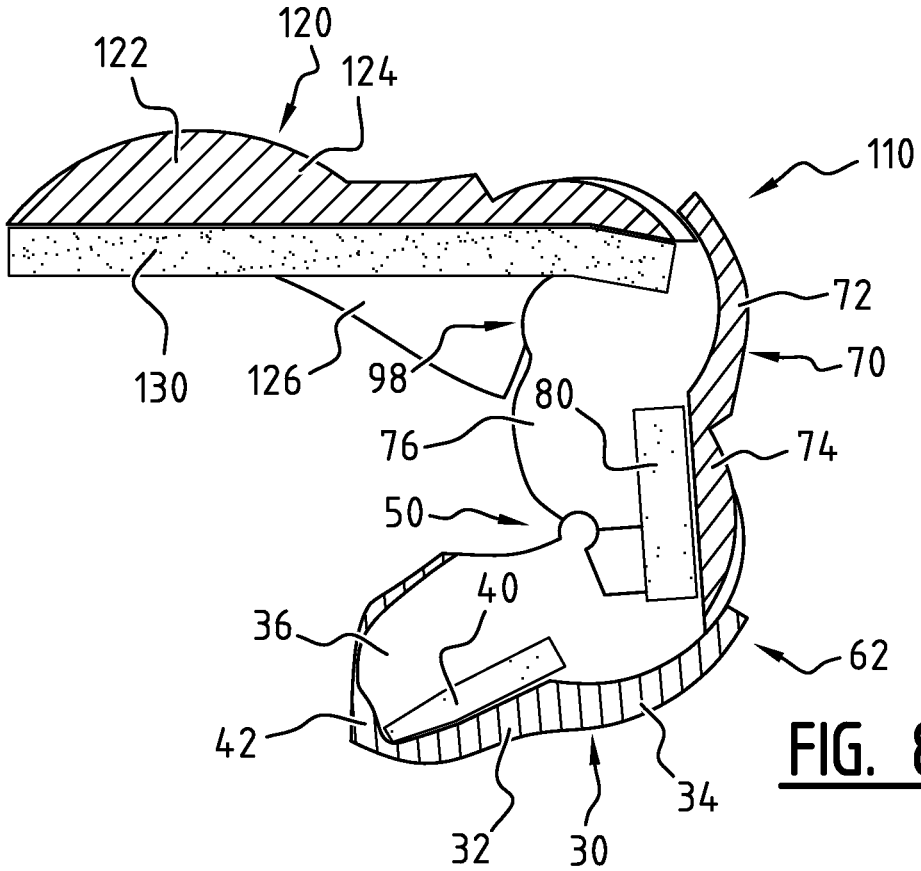
FIG. 8 is a cross sectional view of a finger in the second state of FIG. 6.

As shown in FIGS. 7 and 8, each finger section 30, 70, 120 has preferably a separate damping layer 40, 80, 130. This improves user comfort, as there is no bending or stretching of the damping layer 40, 80, 130 if it is divided over separate finger sections 30, 70, 120 if the finger is moved into the state shown in FIG. 8.

Preferably, the damping layer 40, 80, 130 comprises a foam material, more preferably a Poron-XRD foam.

In order to prevent entrance of pointed objects throughout the full range of motion of a user's hand, the first 30 and second finger section 70 overlap throughout a range of motion of the first pivot 50 connecting the first finger section 30 and the second finger section 70. Likewise, preferably also the second 70 and third finger section 120 overlap throughout a range of motion of the second pivot 98 connecting the second finger section 70 and the third finger section 120 (FIGS. 7 and 8).

The overlap 62, 110 preferably comprises a curvature around said pivot point 50, 98, wherein a sliding contact is maintained between the overlapping finger sections 30, 70 and 70, 120 throughout the range of motion of the respective pivot 50, 98. Due to this curved overlap 62, 110, an impact force on e.g. the second finger section 70 may be transferred to the first finger section 30 via first pivot 50, and transferred to the third finger section 120 via second pivot 98. In this way, also the damping layer 40, 80, 130 of a neighboring finger section 30, 70, 120 may be compressed for absorbing an impact force.

Extra stiffness, even with a limited wall thickness is obtained if at least an outer overlapping part 62 of said first 30 and second finger section 70 comprises a double curved surface. Likewise, preferably also an outer overlapping part 110 of said second 70 and third finger section 120 comprises a double curved surface.

Figure 3:
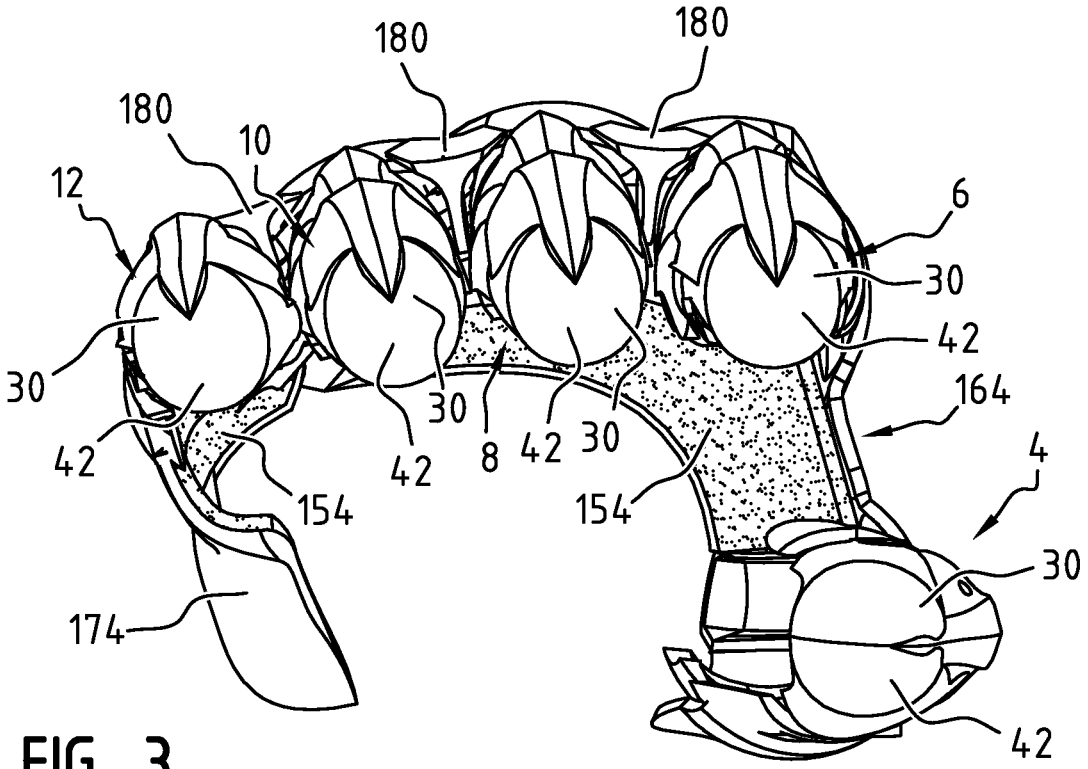
FIG. 3 is a front view from the protective glove according to FIGS. 1 and 2.

The first finger section 30 is a distal finger section configured for protecting a distal phalanx 14 of a finger of said user. The first finger section preferably comprises a distal protection 42 configured for extending past and over a distal end of the user's finger (FIG. 3). The distal protection 42 may be a thimble-like protection, but may also be open on the underside so that a user may maintain sensitive touch.

The protective glove 1 further comprises a dorsal hand section 150 with a further protective layer 152 configured to be at least partially arranged over a part of a dorsal hand 22, i.e. back of the hand, of the user (FIG. 16). The dorsal hand section 150 protects the metacarpal bones of a user's hand 2. In order to provide a user with a full range of motion, the dorsal hand section 150 comprises two overlapping parts, i.e. a first dorsal hand part 160 and a second dorsal hand part 170, having a slanting division 166 extending from substantially at or near or between knuckles 24 of a finger 6, 8, 10 or 12 and a finger 8, 10 or 12 towards an end of a metacarpal bone of a finger 6, 8, 10 or 12 facing a wrist of a user. In FIG. 16, the slanting division extends from substantially at or near or between knuckles 24 of a middle finger 8 and/or of a ring finger 10 towards an end of a metacarpal bone of a little finger facing a wrist of a user.

The dorsal hand section 150 is connected to a sleeve 182 configured to be arranged over a lower arm 28 of a user.

Figure 9:
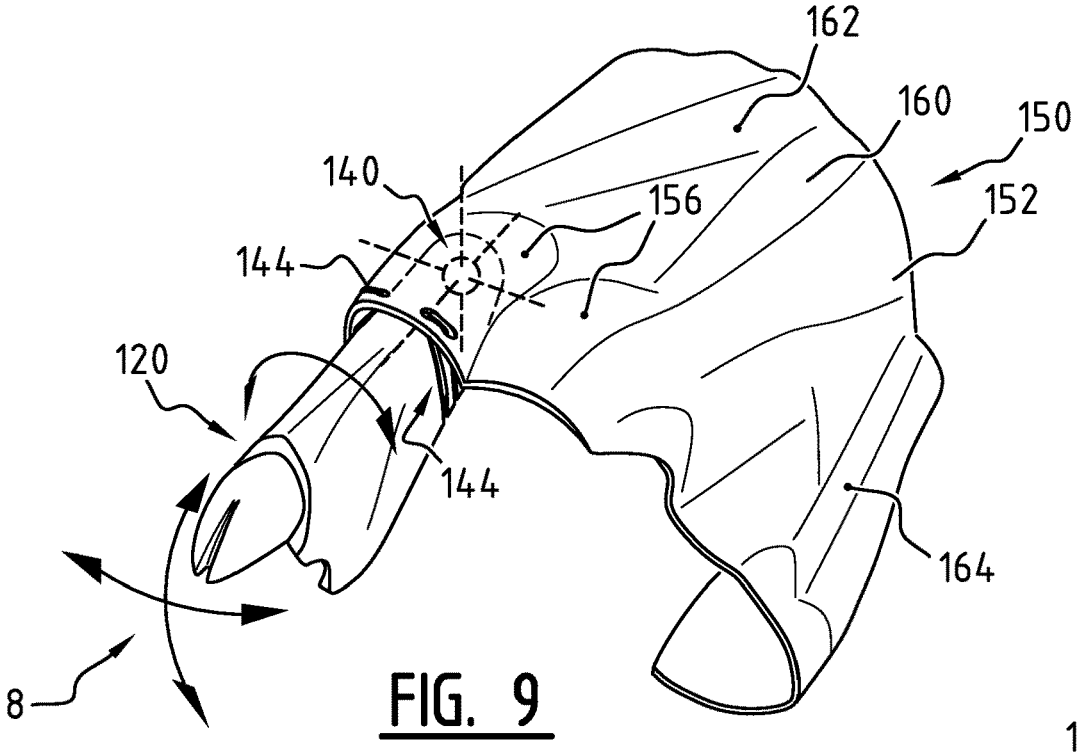
FIG. 9 is a perspective view of a third finger section of a middle finger and a first dorsal hand part of a dorsal hand section.
Figure 10:
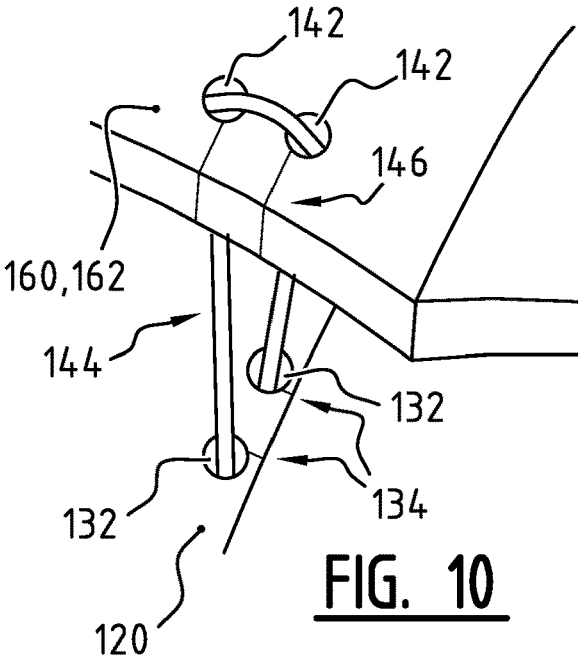
FIG. 10 is a detailed perspective view of FIG. 9.
Figure 11:
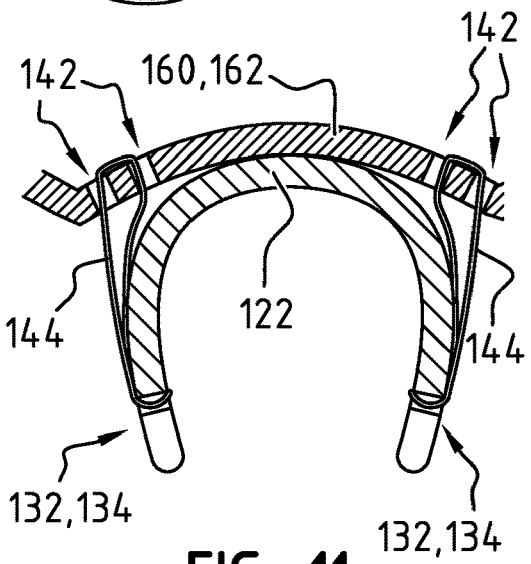
FIG. 11 is a detailed cross sectional view of FIG. 9.
Figure 12:
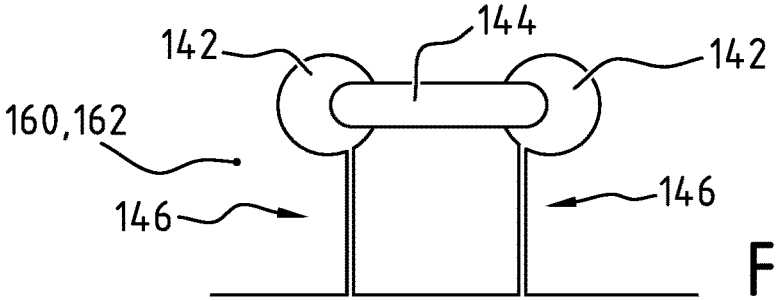
FIG. 12 is a top view of FIGS. 10 and 11.

FIG. 9 shows a third finger section 120 of a middle finger 8 and a first dorsal hand part 160 of a dorsal hand section 150, wherein a third pivot 140 is arranged between the third finger section 120 and the first dorsal hand part 160. It is remarked that for a thumb 4, the third pivot 140 is arranged between the second finger section 70 and the first dorsal hand part 160.

The dorsal hand section 150 comprises double curved areas 156 at or near a knuckle 24 of the user's hand 2. The double curved areas 156 overlap the second finger section 70 of a thumb 4 or a third finger section 120 of a finger 6, 8, 10, 12, and functions as a ball joint. The double curved areas 156 provide stiffness even at a reduced wall thickness, and further provide a range of motion that allows pan, roll and tilt of the finger section 70, 120 relative to the dorsal hand section 150. This movement is indicated for the proximal phalanx 18 of a middle finger 8 with the arrows in FIG. 9.

As shown in FIGS. 9-12, the connection between the second finger section 70 of a thumb 4 or a third finger section 120 of a finger 6, 8, 10, 12 and the dorsal hand section 150 preferably comprises a cable or elastic 144 that passes through holes 142 of the third pivot 140. Slots 146 may be arranged for easy assembly of a cable or elastic 144, i.e. holes 132 and slots 134 in third finger section 120 (or second finger section 70 of a thumb 4).

Figure 13:
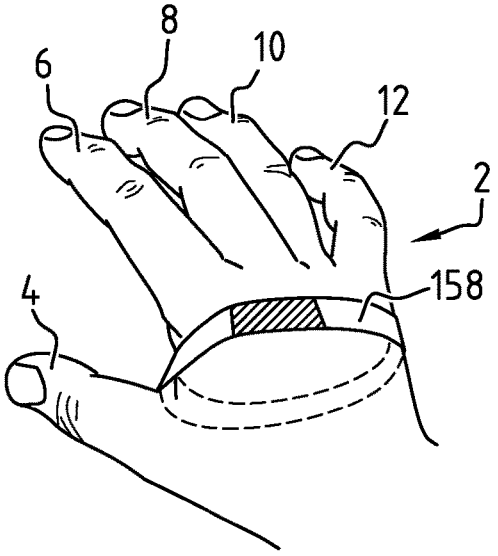
FIG. 13 shows a hand with an elastic band.
Figure 14:
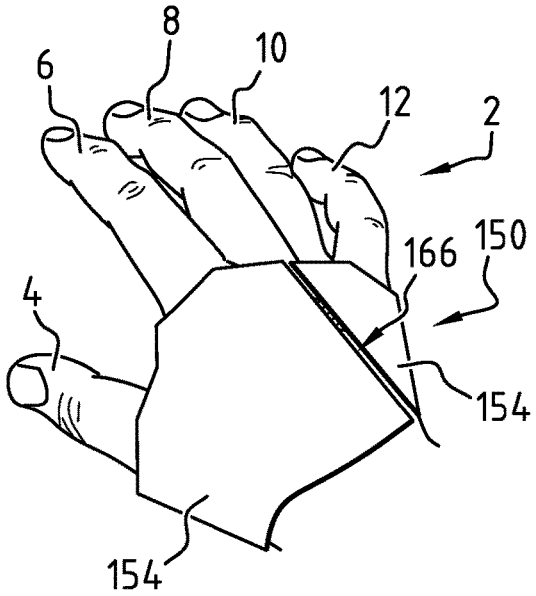
FIG. 14 shows the hand of FIG. 13 with a damping layer of a dorsal hand section arranged on the elastic band.

Both the first dorsal hand part 160 and the second dorsal hand part 170 of the dorsal hand section 150 comprise a protective layer 152 and a damping layer 154. As can be seen in FIG. 16, the first 160 and second dorsal hand part 170 comprise an overlap 168, which covers the respective damping layers 154 (FIG. 14). The damping layers 154 may be arranged on an elastic band 158 (FIG. 13).

The protective layer 152 of the first dorsal hand part 160 comprises a base 162 and a leg 164. The leg 164 extends along the thumb side of the hand 2, and preferably extends a distance from the base 162 that is large enough to reduce the chance that metacarpal bones of a user's hand 2 are being crushed by a heavy load.

Likewise, the protective layer 152 of the second dorsal hand part 170 comprises a base 172 and a leg 174. The leg 174 extends along little finger side of the hand 2, and preferably extends a distance from the base 172 that is large enough to reduce the chance that metacarpal bones of a user's hand 2 are being crushed by a heavy load.

The space enclosed by the legs 164, 174, the bases 162, 172 and the damping layers 154 is preferably enough to allow circulation of blood even when the hand 2 is stuck between two objects.

The protective glove 1 preferably further comprises at least one protective flap 180 extending from said dorsal hand section 150 over at least a part of two adjacent third finger sections 120, preventing pointed objects penetrating between adjacent fingers into the hand 2. The protective flap 180 transfers any impact force to the third finger sections 120 it rests on, and in this way a force may be absorbed by the protective later 122 and damping layer 130 of the respective third finger sections 120.

The protective layer 32, 72, 122, 152 preferably has a Young's modulus in the range of 0.1-2 GPa, which provides connection to the hand, for example clamping the finger, without causing the sensation of pressure, even while moving from the first to the second state and thus increasing the width of the finger.

FIGS. 17-21 show further embodiments that provide some alternatives for aspects of the first embodiment shown in FIGS. 1-16. One or more than one of the following alternatives may replace or be combined with aspects of the first embodiment of FIGS. 1-16.

FIGS. 6-8 of the first embodiment show that the first 30 and second finger section 70 overlap throughout a range of motion of the first pivot 50 connecting the first finger section 30 and the second finger section 70. Similarly, the second finger section 70 and the third finger section 120 overlap throughout a range of motion of second pivot 98.

As described before, such a curved overlap 62, 110 prevents entrance of pointed objects throughout the full range of motion of a user's hand. The curved overlap 62, 110 also assists in transferring an impact force on e.g. the second finger section 70 to the first finger section 30 via first pivot 50, and transferring such impact force to the third finger section 120 via second pivot 98. In this way, also the damping layer 40, 80, 130 of a neighboring finger section 30, 70, 120 may be compressed for absorbing an impact force.

Figure 17:
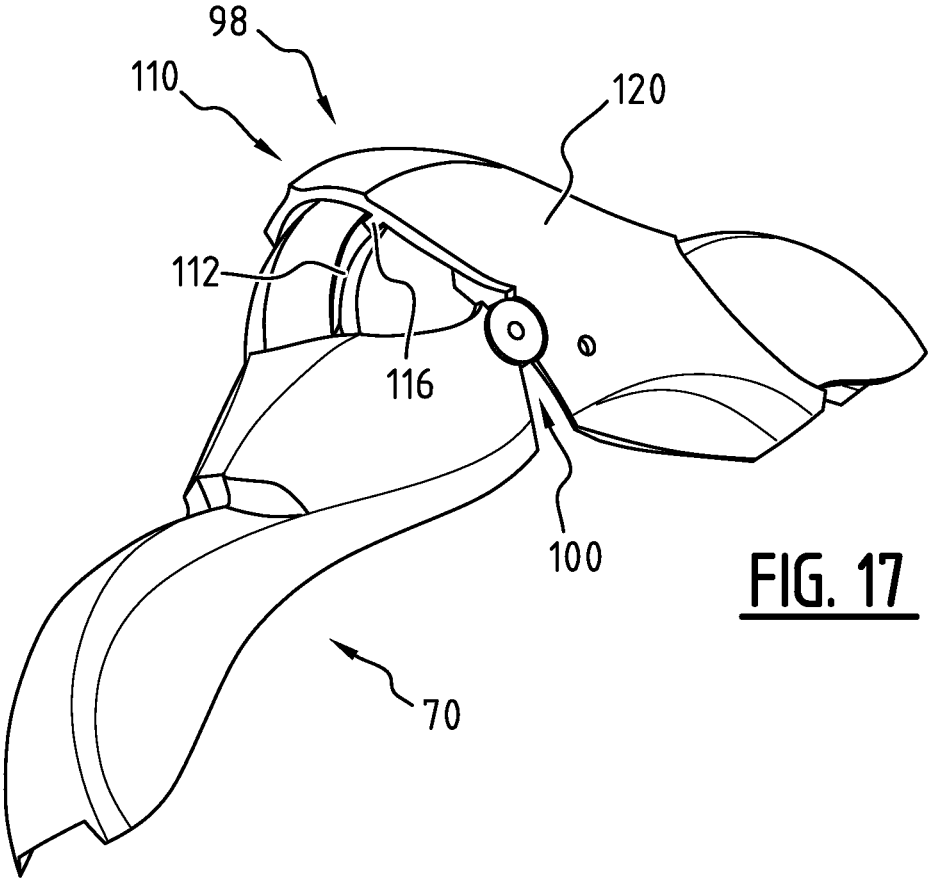
FIGS. 17-19 are perspective views of a pivot connection between finger sections according to a further embodiment of the invention.
Figure 18:
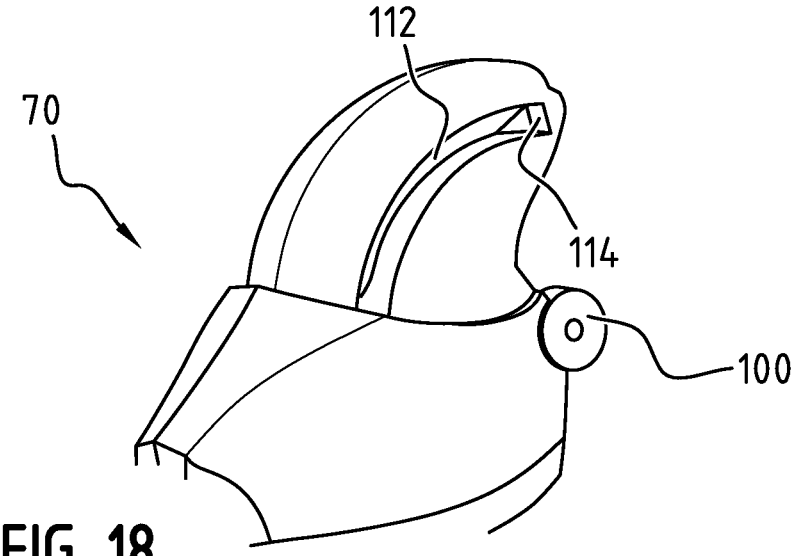
Figure 19:
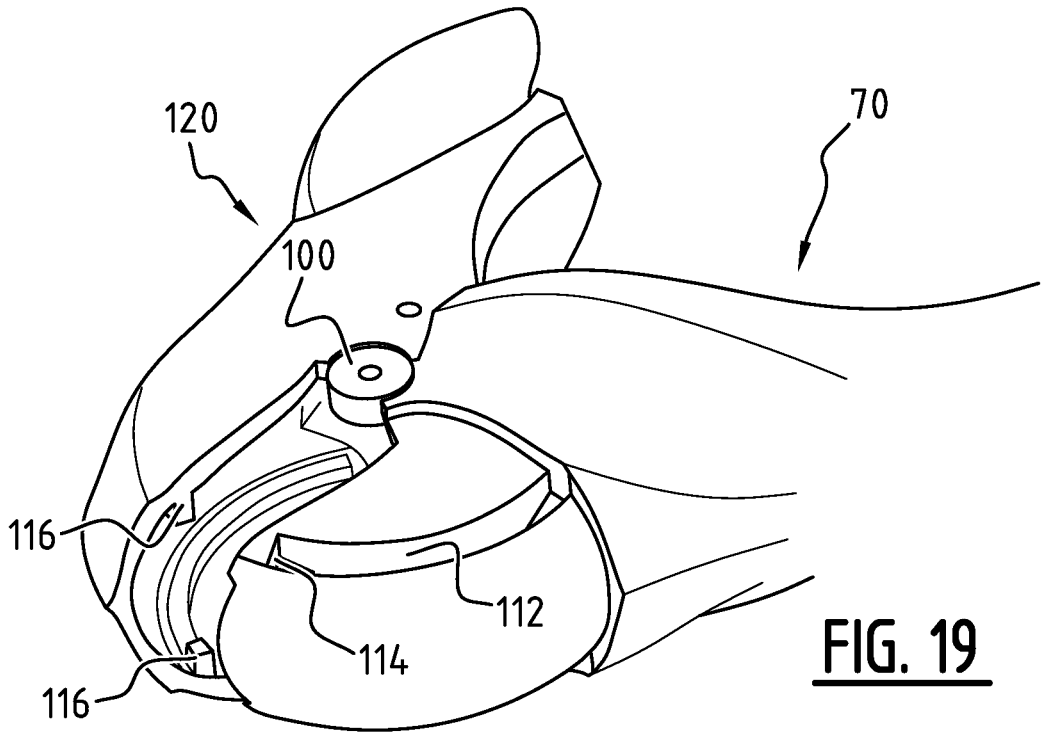

In FIGS. 17-19, second pivot 98 is shown in an alternative and even more preferred embodiment. Although not shown and described in detail, a similar configuration may be applied for the first pivot 50.

In FIGS. 17-19, second pivot 98 comprises a curved overlap 110 of second finger section 70, wherein curved overlap 110 comprises a guide slot 112. The third finger section 120 comprises a protrusion 116 (a second protrusion to the mating finger sections) that is configured to mate with said guide slot 112. Guide slot 112 and mating protrusion 116 add rigidity to the finger sections 70, 120 of the protective glove 1 and prevent a relative torsion between the second finger section 70 and the third finger section 120. They also assist in maintaining a correct position of second pivot 98.

Guide slot 112 comprises an abutment 114 configured to function as a stop for said protrusion 116. This stopping function of the abutment 114 limits the range of motion of said pivot 98. In this way, the curved overlap 110 can be maintained even under severe impact conditions, thereby safeguarding that even in extreme situations no gap will occur, and entrance of pointed objects will be prevented. Abutment 114 can be seen in FIGS. 18 and 19. It is remarked that for elucidation of the configuration FIG. 19 shows a situation where protrusion 116 has moved past abutment 114 of guide slot 112. In practice, this situation will never occur, since protrusion 116 will abut against abutment 114, as shown in FIG. 17.

Figure 20:
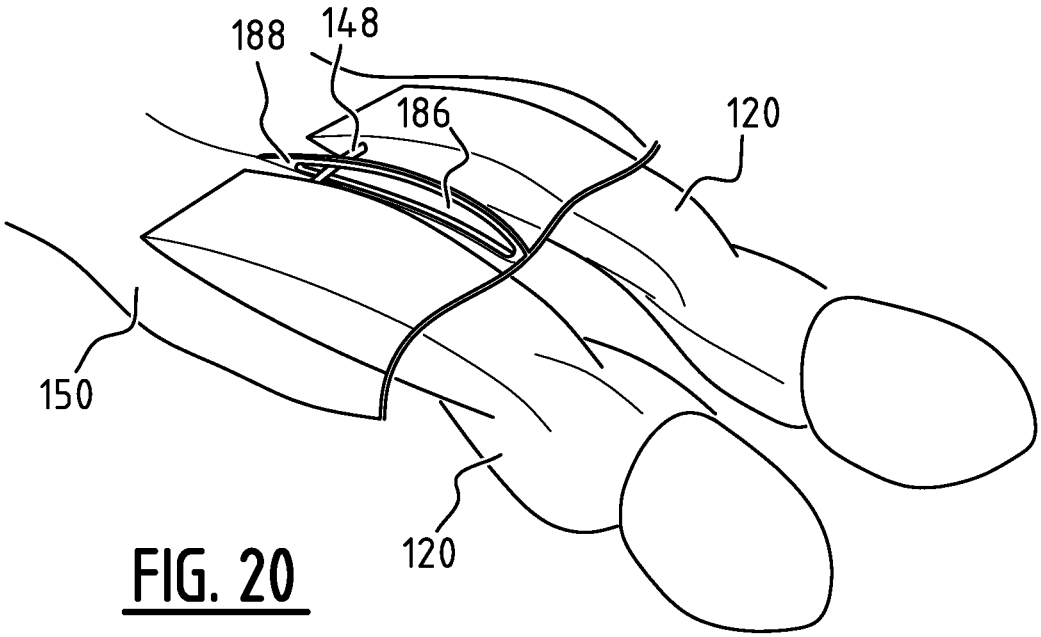
FIG. 20 is a perspective view of a connection between a dorsal hand section and third finger sections according to a further embodiment of the invention.

For the first embodiment, the connection between the third finger sections 120 and the dorsal hand section 150 has been described using FIGS. 9-12. According to an alternative and even more preferred embodiment, one or more than one third finger section 120 is pivotable and slideable arranged in a guide slot 186 of said dorsal hand section (FIG. 20). This guide slot 186 is preferably arranged between adjacent third finger sections 120, e.g. in a transverse wall 188. The adjacent third finger sections 120 may then be connected with a connection 148 that extends through said guide slot 186 between said adjacent third finger sections 120. A flexible connection 148, e.g. using a cable, cord or the like, adds flexibility between adjacent third finger sections 120. Transverse wall 188 extend from the dorsal hand section 150 towards the hand of said user, but due to its limited height there will be no contact between the user's hand and the edge of transverse wall 188. Compared to the connection of the first embodiment, the alternative embodiment of FIG. 20 can be moved with even less muscle force, thereby further reducing fatigue and increasing user comfort.

In the first embodiment, dorsal hand section 150 comprised two overlapping parts, i.e. a first dorsal hand part 160 and a second dorsal hand part 170, having a slanting division 166 extending from substantially at or near or between knuckles 24 of a middle finger 8 and/or of a ring finger 10 towards an end of a metacarpal bone of a little finger facing a wrist of a user (FIG. 16).

Figure 21:
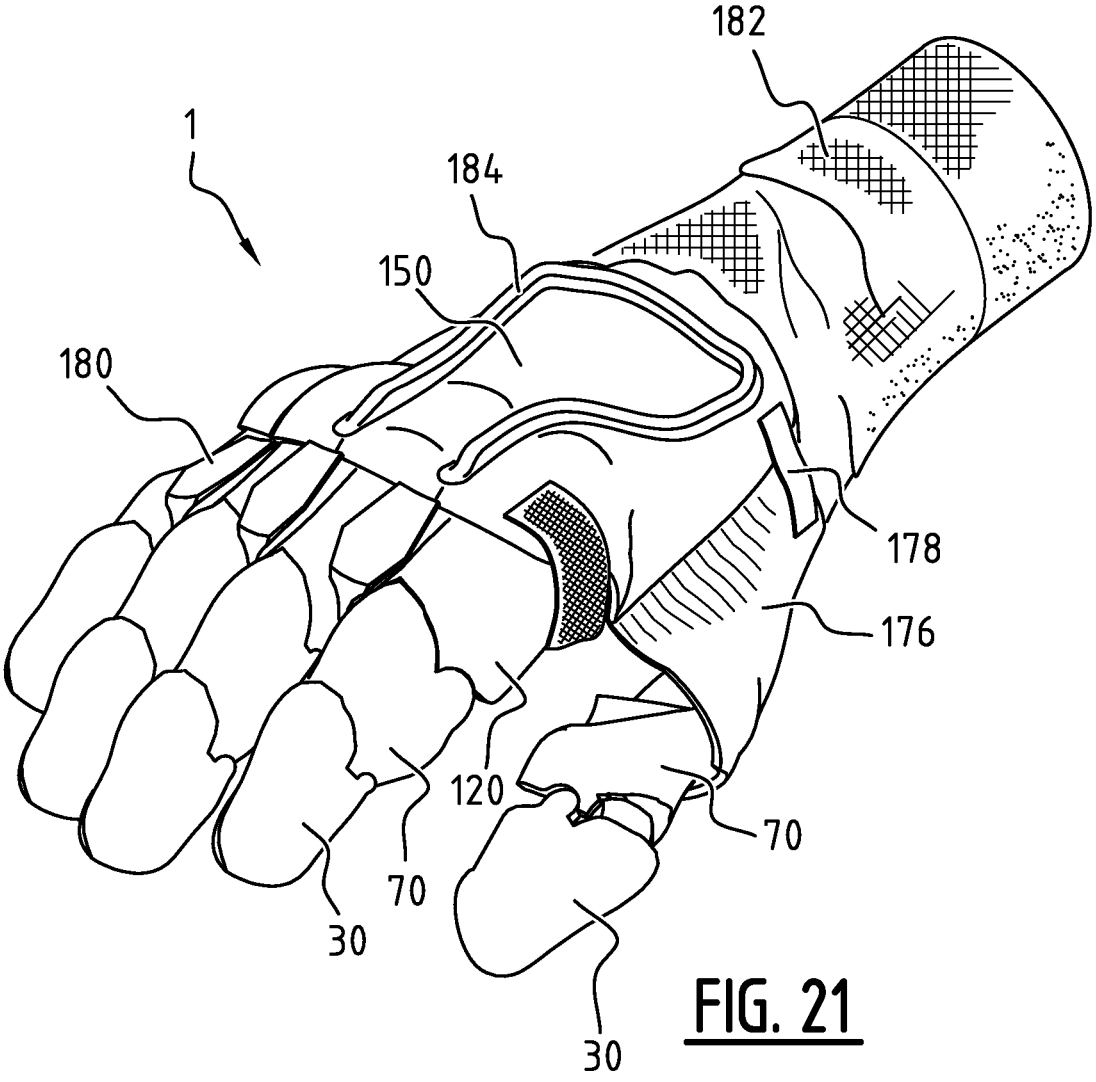
FIG. 21 is a perspective view of an alternative dorsal hand section and thumb cover part according to a further embodiment of the invention.

According to an alternative and even more preferred embodiment, a thumb cover part 176 is pivotally connected to said dorsal hand section 150 (FIG. 21). This configuration adds further flexibility to the protective glove 1, and allows the thumb to be moved freely while maintaining a protective cover around said thumb. The pivot connection 178 between dorsal hand section 150 and thumb cover part 176 is arranged near the edge of the dorsal hand section 150 that faces the wrist of the user, and may comprise a strap or band. This is substantially near the carpometacarpal joint of the thumb. It is remarked that the straps shown in FIG. 21 may also be arranged below the dorsal hand section 150 and thumb cover part 176.

In order to prevent that a gap might occur through which (pointed) objects may impact the user's hand, the dorsal hand section 150 and the thumb cover part 176 overlap over their range of motion. This range of motion is the range of motion during use, i.e. when worn by a user, thus when fitted over a user's hand. This range of motion will then be limited by the biomechanics of the user's hand and not by the protective glove 1.

As shown in FIG. 21, said dorsal hand section 150 may comprise one or more than one strengthening rib 184.

Preferably, the dorsal hand section 150 is slightly curved, providing a distance between the dorsal hand section and the non-contact area 27 (FIG. 15) of the user's hand 2.

Figure 22:
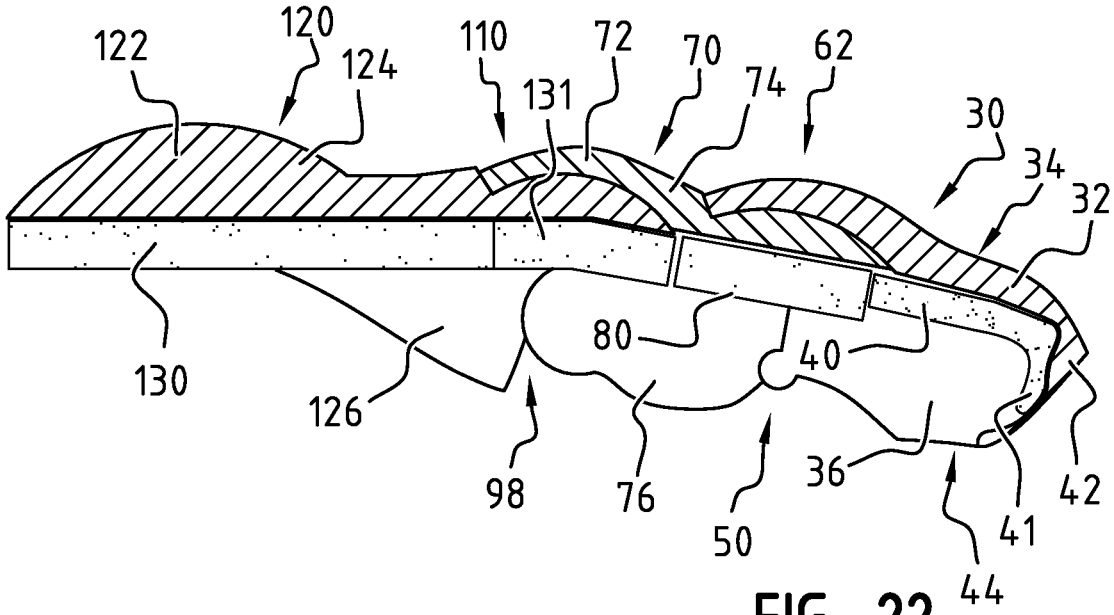
FIG. 22 is a cross sectional side view of a finger of a further embodiment in a first state.
Figure 23:
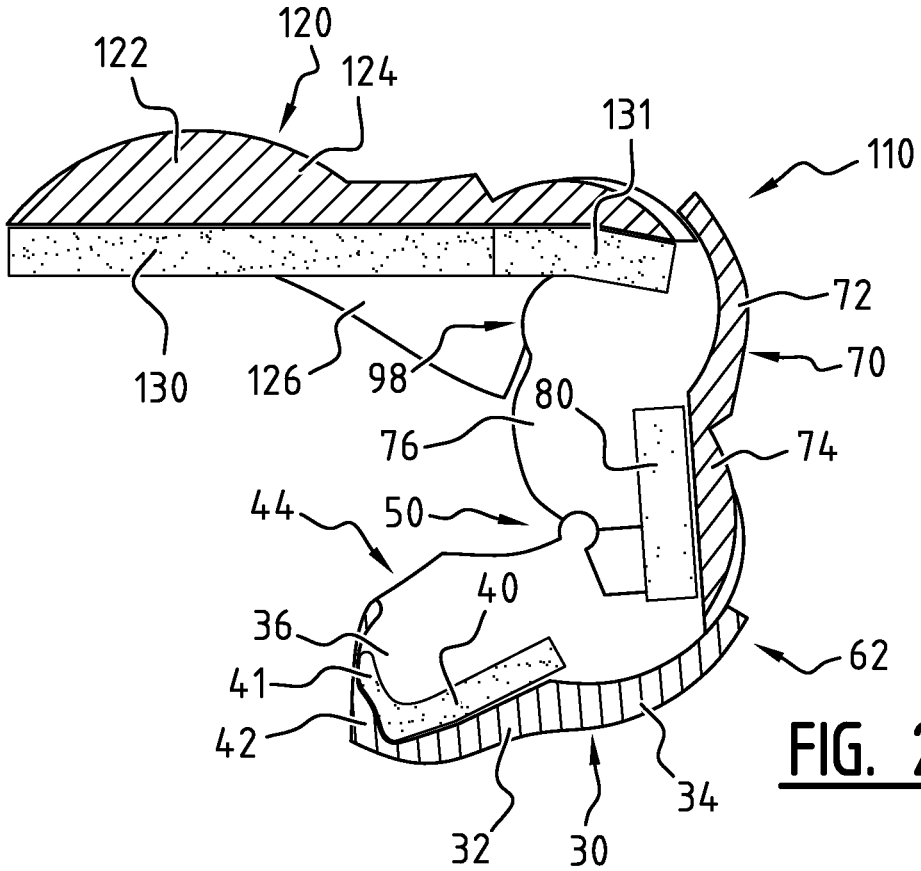
FIG. 23 is a cross sectional side view of the finger of FIG. 22 in a second state.

The cross sectional side views of FIGS. 22 and 23 strongly relates to the embodiment shown in FIGS. 7 and 8. There is however provided a further damping layer 131 which has different properties from the damping layer 130, thereby allowing to adapt specific areas Preferably, the further damping layer 131 comprises a synthetic rubber, e.g. a silicone rubber or polyurethane (PU), instead of the foam for the damping layer 40, 80, 130.

Preferably, the further damping layer 131 comprises a Shore A hardness below 8. More preferably comprises a Shore 00 hardness below 55, and even more at or below a Shore 00 hardness value of 50.

In the embodiment of FIGS. 22 and 23, the damping material 40 has an extension 41 extending along a part of the distal protection 42. During use, extension 41 protects a front side of a fingertip 13 against impact forces, which are partly absorbed by the damping material 40 in extension 41.

Furthermore, the first finger section 30 is provided with an opening 44. As can be best seen in FIG. 25, the opening 44 in first finger section 30 allows a user to touch an object with his/her bare fingers, thereby providing optimum tactility.

Figure 24:
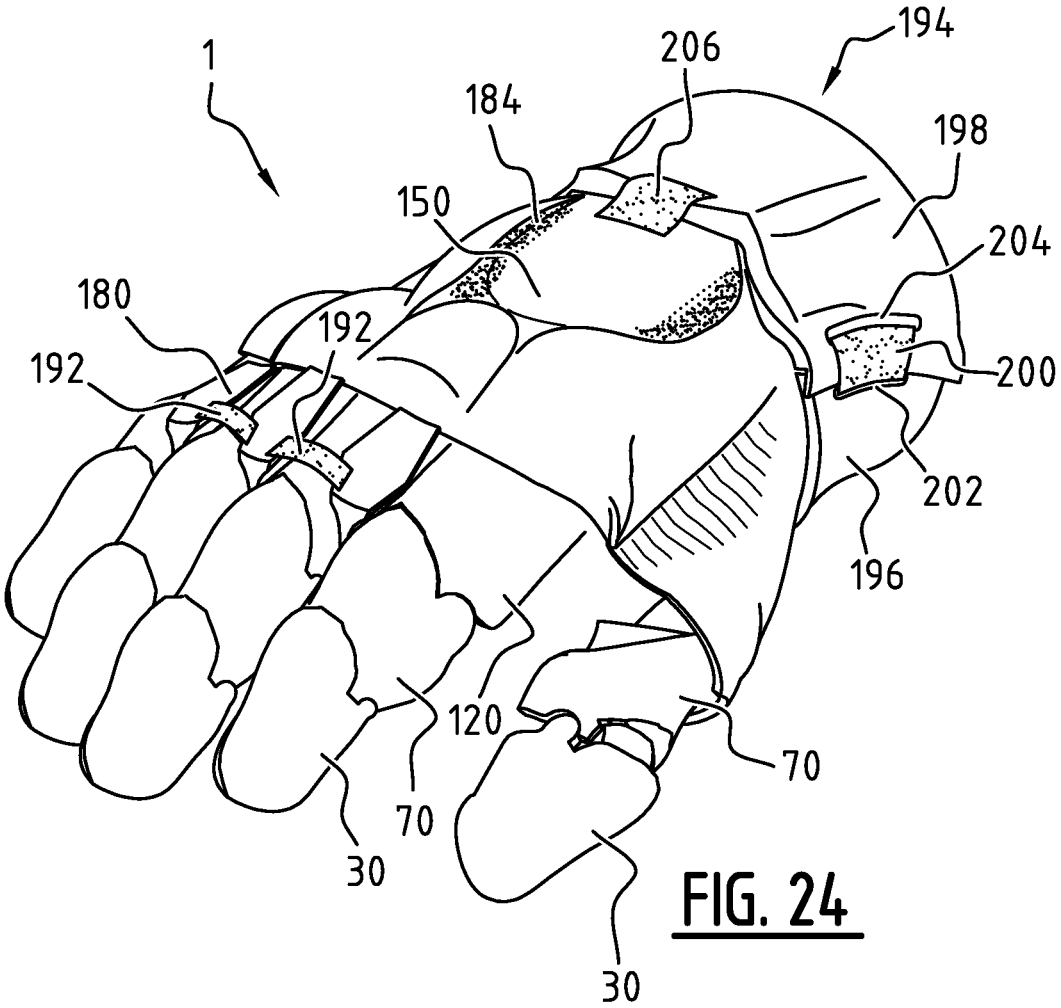
FIG. 24 is a perspective view of a protective glove according to a further embodiment of the invention.

The embodiment shown in FIG. 24 comprises a wrist protector 194. The wrist protector 194 widens in a direction away from the dorsal hand section 150, thereby providing manoeuvrability.

In order to provide flexibility, the wrist protector 194 comprises at least a first wrist protector part 196 and a second wrist protector part 198. In the shown embodiment, the first and second wrist protector parts 196, 198 are each provided with a respective slot 202, 204, in which a strap 200 is arranged. A further strap 206 connects the wrist protector 194 and the dorsal hand section 150.

Figure 25:
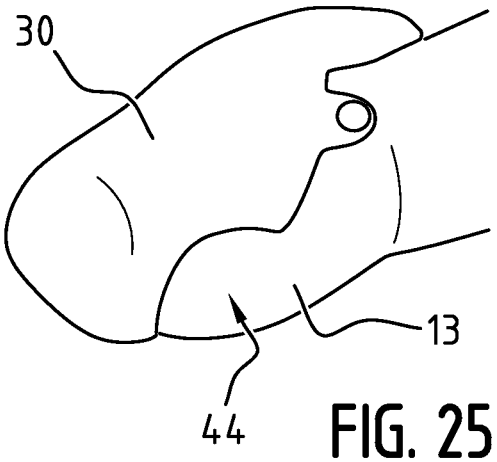
FIG. 25 is a perspective view of a first finger section arranged on a finger.

In the embodiment of FIG. 25, protective flaps 180 are connected via a substantially flexible connection 192, preferably a strap or band.

Although they show preferred embodiments of the invention, the above described embodiments are intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims.

Furthermore, it is particularly noted that the skilled person can combine technical measures of the different embodiments. One or more than one of the alternatives shown in FIGS. 17-25 may replace or be combined with aspects of the first embodiment of FIGS. 1-16.

For example, although the dorsal hand section is shown as a single part in FIG. 21, a thumb cover part 176 may also be combined with a dorsal hand section 150 comprising a first dorsal hand part 160 and a second dorsal hand part 170 as shown in FIGS. 1-2 and 16. Thus, instead of the first dorsal hand part 160 also covering the thumb, a separate thumb cover part 176 may be applied. This would result in a dorsal hand section 150 with a first dorsal hand part 160 and a second dorsal hand part 170, wherein a thumb cover part 176 is pivotally connected to first dorsal hand part 160.

The scope of the invention is therefore defined solely by the following claims.

The invention claimed is:

1. A glove, comprising:

at least a first finger section and a second finger section, each finger section being separated from one another and comprising a protective layer configured to be at least partially arranged over a finger part of a user; and a pivot connecting said first finger section and said second finger section;

wherein said pivot has a pivot axis that is adapted to coincide with a finger joint of a user's hand;

wherein one of the first and second finger section comprises a rounded protrusion and wherein the other of the first and second finger section comprises a corresponding rounded recess configured to receive said rounded protrusion for sliding movement between the rounded protrusion and the rounded recess, said protrusion and recess being separate pieces together forming said pivot connecting said first finger section and said second finger section;

wherein the glove is a protective glove;

wherein the arrangement of the protrusion and recess provide the pivot with a relationship in which there is no lateral overlap, defined in a direction along the pivot axis, between the first and the second finger sections at the pivot; and wherein the first and second finger section and said pivot define a substantially continuous and flush wall.

2. The glove according to claim 1, wherein the first finger section and the second finger section have a wall extending from the pivot substantially along a whole length of a phalanx of a user's finger, said wall being configured to provide lateral side protection of said finger.

3. The glove according to claim 1, wherein said pivot is arranged on or near a neutral line of a finger of said user, said neutral line defining the same length between a knuckle and the tip of a respective finger in the extended and bend state of said finger.

4. The glove according to claim 1, wherein the first and second finger sections are connected via a cable passing through said pivot.

5. The glove according to claim 1, wherein the protective layer has a U-shape having a base and two legs, wherein a wall thickness of the base is at least two times more than a wall thickness of at least one of the legs of said U-shaped protective layer; the glove further comprising a damping layer arranged against said base of said U-shaped protective layer and configured to be arranged against a finger part of said user.

6. The glove according to claim 5, wherein a finger section comprises an outer leg of the U-shaped protective layer on an outer side facing away from said glove, said outer leg having a larger wall thickness than an inner leg of said U: shaped protective layer of said outer finger;

the glove further comprising a further damping layer arranged against said outer leg of said U-shaped protective layer and configured to be arranged against a finger part of said user.

7. The glove according to claim 5, wherein each finger section has a separate damping layer; and wherein said damping layer comprises a foam material.

8. The glove according to claim 1, wherein the first and second finger section have an overlap throughout a range of motion of said pivot connecting said first finger section and said second finger section; wherein the overlap comprises a curvature around said pivot point, wherein a sliding contact is maintained between the overlapping first and second finger section throughout the range of motion of said pivot; wherein the curved overlap comprises a guide slot arranged on one or more than one of:

one of the first finger section and the second finger section, and a second protrusion on the other of the first finger section and the second finger section, wherein said second protrusion is configured to mate with said guide slot; and one of the second finger section and the third finger section, and a second protrusion on the other of the second finger section and the third finger section, wherein said second protrusion is configured to mate with said guide slot.

9. The glove according to claim 8, wherein the guide slot comprises an abutment configured to function as a stop for said second protrusion, said stop limiting the range of motion of said pivot.

10. The glove according to claim 8, wherein at least an outer overlapping part of at least one of said first and second finger section comprises a double curved surface.

11. The glove according to claim 1, wherein said first finger section is a distal finger section configured for protecting a distal phalanx of a finger of said user, wherein said first finger section comprises a distal protection configured for extending past and over a distal end of the user's finger.

12. The glove according to claim 1, further comprising a dorsal hand section with a further protective layer configured to be at least partially arranged over a part of a dorsal hand of said user;

wherein said dorsal hand section comprises a first dorsal hand part and a second dorsal hand part which overlap and have a slanting division configured to extend from substantially at or near or between a knuckle of at least one of a middle finger and a ring finger towards an end of a metacarpal bone of a little finger facing a wrist of a user; and wherein a thumb cover part is pivotably connected to said dorsal hand section;

and wherein the dorsal hand section and the thumb cover part overlap over their range of motion.

13. The glove according to claim 12, wherein the dorsal hand section comprises double curved areas at or near a knuckle of the user's hand, said double curved areas overlapping the second finger section or a third finger section.

14. The glove according to claim 12, wherein one or more than one third finger section is pivotable and slideably arranged in a guide slot of said dorsal hand section;

wherein said guide slot is arranged between adjacent third finger sections; and wherein the adjacent third finger sections are connected with a connection that extends through said guide slot between said adjacent third finger sections.

* * * * *